United States Patent [19]

Berkowitz et al.

[11] 4,202,573

[45] May 13, 1980

[54] SAFETY CLOSURE SYSTEM

[75] Inventors: Irving L. Berkowitz, Binghamton; John J. Bourgeois, Kirkwood, both of N.Y.

[73] Assignee: Kason Hardware Corporation, Binghamton, N.Y.

[21] Appl. No.: 814,408

[22] Filed: Jul. 11, 1977

[51] Int. Cl.[2] ..... E05C 3/16

[52] U.S. Cl. ..... 292/223

[58] Field of Search ..... 292/216, 223, DIG. 65, 292/DIG. 71, 123, 226

[56] References Cited

U.S. PATENT DOCUMENTS

| | | | |
|---|---|---|---|
| 2,823,940 | 2/1958 | Squire | 292/DIG. 71 |
| 2,893,772 | 2/1978 | Edwards | 292/223 |
| 3,045,465 | 7/1962 | Larson | 292/223 X |
| 3,190,682 | 6/1965 | Fox et al. | 292/216 |

*Primary Examiner*—Richard E. Moore
*Attorney, Agent, or Firm*—Paul J. Sutton

[57] ABSTRACT

The present invention provides a safety door-mounted latch mechanism available and accessible from within an enclosure that is normally locked by means of the door. A freezer or refrigerator door, for example, may be provided with the latch which is capable of being locked from the outside by means of either a padlock or an integral cylinder which receives a key. A radial tongue of the latch cooperatively engages a striker mechanism. The result is the ability of a person otherwise trapped within the enclosure to reach safety. A novel linkage-type of mechanism having a plurality of pivot points translates rectilinear actuating movement into an arcuate movement of the tongue or keeper member.

2 Claims, 10 Drawing Figures

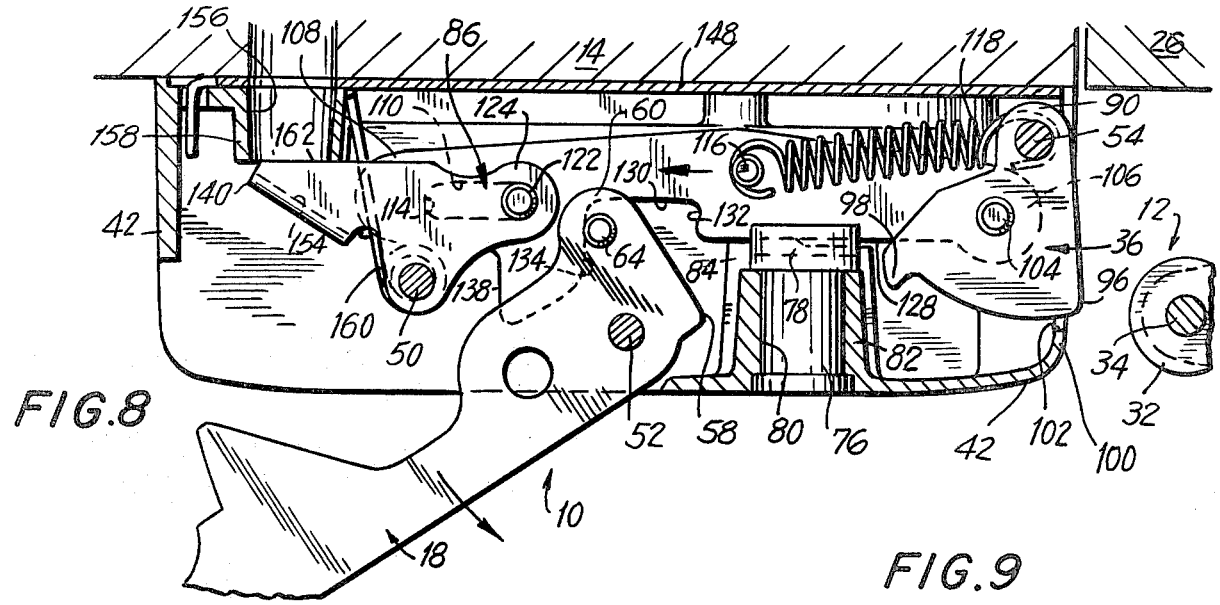
FIG.8
FIG.9
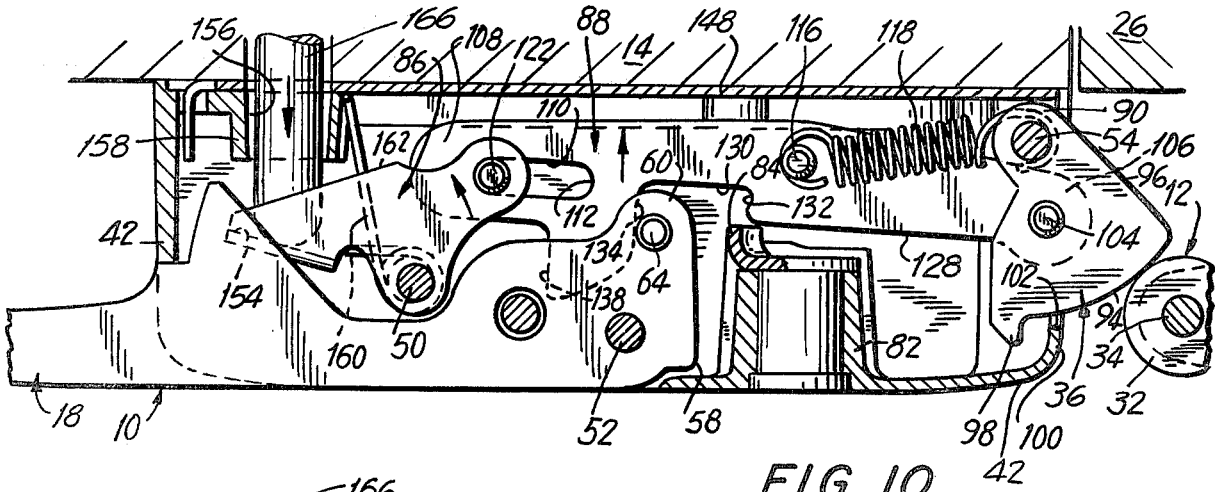
FIG. 10
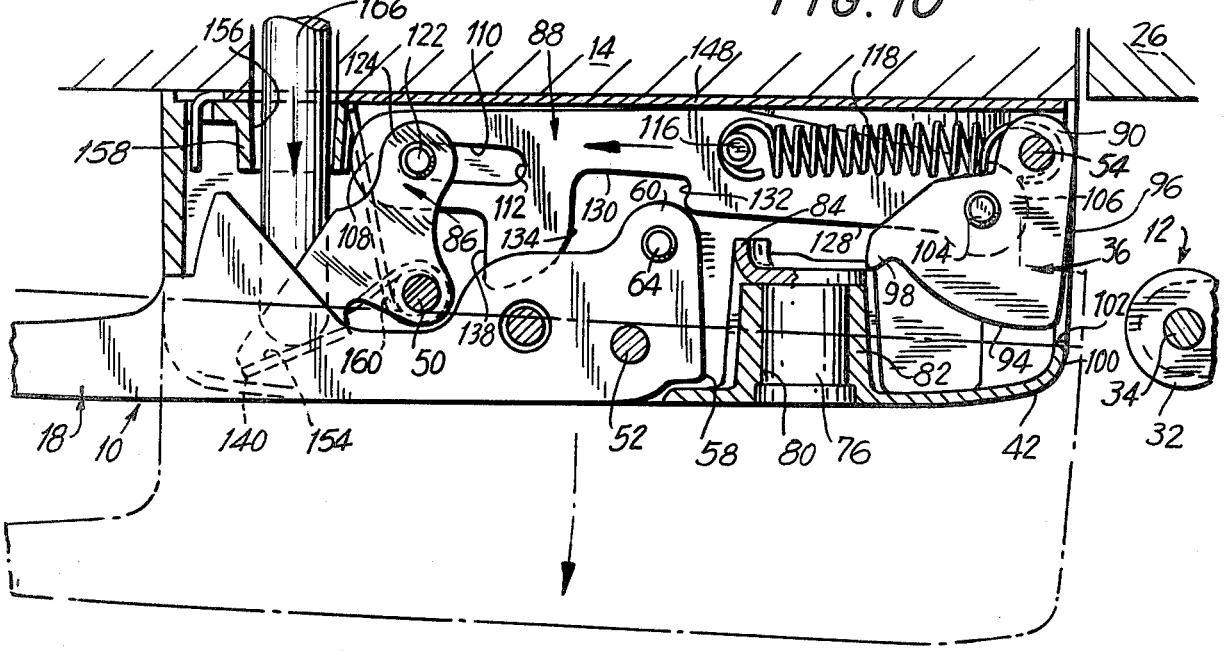

SAFETY CLOSURE SYSTEM

This invention relates generally to door latch and striker devices, and more particularly to an improved safety latch assembly for refrigerator and other doors which can be easily and conveniently mounted on a door, such that persons caught inside the structure containing the door may simply and quickly open the door.

A number of persons every year are locked and trapped inside coldrooms, such as commercial freezers and refrigerators. Some die of the cold and many are terrorized by their inability to escape or manifest their presence inside the room. Many coldroom door latches may be locked by key, and since the very thick doors usually associated with coldrooms have a very high sound insulation, the risks of a locked-in person being unable to make his presence in a large coldroom known to others outside the coldroom is quite high.

On the other hand, there is often good reason for having a coldroom door latch that may be locked by key. Security and inventory-control measures often justify the use of locking means. There is, therefore, a growing need for a latch-striker cooperative assembly that possesses both primary features of being securely lockable as well as being safe. The latter feature is thought by many to be the paramount feature.

Many efforts to solve these problems have been made and are known to the art. A search of U.S. Patent Office records will reveal a host of prior art patents which specifically deal with mechanical means for preventing the entrapment of children in household and discarded refrigerators. Some, for example, utilize the child's weight to a trigger door-releasing device. Most are quite complicated, mechanically speaking, and their reliability leaves much to be desired.

Let us look now at certain prior art patents which, while not anticipatory of the present invention, disclose representative examples of previous or known efforts to solve some of the structural problems associated with the art embodying this invention. U.S. Pat. No. 3,346,288 to Cosentino discloses a safety lock device which provides for the opening of a lock from inside or outside of a locked structure. FIG. 3 of this patent illustrates a schematic representation of what is believed to be a rather unreliable linkage-type of mechanism. A lever 12 formed with a hooked end 18 extends into a door 82 such that hooked end 18 engages portion 92 of a latch element. This engagement between the lever and latch element is supposed to prevent the opening of door 82. However, from the drawing a question is raised as to the effectiveness of the very lock itself. In order to utilize the Cosentino apparatus from inside the chamber 44 with which this mechanism is used, lever 12 is pivoted by means of the linkage and in response to a depression of pedal 68 such that hooked portion 18 rises in an arcuate motion about the pivot point represented by a rivet 16 until the hooked end portion 18 biases the latch portion 92 against the force of a spring 95 until this latch is pivoted and held by means of the same spring in a position illustrated in FIG. 4. In other words, in order to escape from the enclosure 44 utilizing the Cosentino disclosure, it is necessary to manipulate and work the inner latch mechanism associated with latch handle 96. A considerable amount of movement, relatively speaking, is required since it is necessary to move spring 95 off center such that it is biasing latch element 88 in a clockwise direction, as opposed to the normally locked counterclockwise direction. The counterclockwise direction is best illustrated in FIG. 3, while the clockwise biasing is best illustrated in FIG. 4.

U.S. Pat. No. 3,412,586 to Sterner similarly discloses a safety lock for coldrooms and the like wherein a rotatable keeper for use with a locking bolt is formed with a notch occupying a portion of the cross section of this keeper. During the normal locked position, this bolt 3 is shown in FIG. 3 of this patent to engage and interfere with the rectilinear retraction of keeper 9, which has a generally cylindrical shape. However, upon rotation of keeper 9 to a position illustrated in FIG. 7, for example, the bolt is forced to assume a position in which it bears against the unnotched part of the keeper in a configuration which will enable the opening of the door from inside the room closed by this door without the use of a key.

Again, as in the case of the Cosentino patent, the Sterner mechanism requires a manipulation of the latch mechanism—in this case the bolt against the normally downward biasing force of spring 4.

U.S. Pat. No. 2,772,110 to Petrochko discloses a safety striking plate for use with door locks and illustrates the use of a retractable bolt member normally seated within a socket of the keeper member to prevent the keeper from pivoting. FIG. 6 of the Petrochko patent illustrates the retracted bolt, but also illustrates the need for interfering pivotal movement of the keeper in order for the latch to move to an open position.

U.S. Pat. No. 2,966,864 to Weaver discloses a refrigerator lock with an inside release, designed particularly for adaptability for use on household refrigerators, and wherein the keeper of this latch assembly may be disabled by a trigger mechanism mounted within the refrigerator or enclosure so that the latch mechanism is rendered ineffectual so long as any slight force or pressure is applied to the trigger mechanism.

U.S. Pat. No. 2,747,906 to Emmert discloses an inside control for refrigerator door latches. The particular concept presented includes a latch mechanism which is released by exactly the same motion when locked as when unlocked, so that there is no necessity for a user of the refrigerator to be taught any special emergency opening procedure.

U.S. Pat. No. 3,650,554 to Tharp discloses a tamper-proof locking mechanism which makes it impossible for an object to be wedged between the door and the door-latch for entry.

U.S. Pat. No. 2,762,645 to Bordner discloses a keeper for use with a latch which is mounted to move away from the bolt but normally is held out of engagement therewith by a member that is shiftable from inside the door to a position in which the strike may be moved away from the bolt.

U.S. Pat. No. 1,573,866 to Rogers discloses a type of latch construction wherein combination sliding and pivotal motion is utilized, as best seen in the drawings of this patent.

U.S. Pat. No. 2,246,787 to Dall discloses a latch structure for use in latching the covers or hoods of automobile engine enclosures.

U.S. Pat. No. 3,045,464 to Braginetz discloses a swing-door latch-lock mechanism for use with a swinging door or panel wherein the stile of the swing panel overlaps the stile of a fixed panel of a multi-panel partition, thereby providing a latching arrangement which will prevent opening of the swing panel from the outside by manipulation of the latch releasing means.

U.S. Pat. No. 2,849,250 to Williamson discloses an emergency release latch mechanism with particular application in refrigerators, as best seen in the drawings, with particular emphasis on the relatively small forces required to activate the mechanism, such as would be the case of a panic-stricken child who has been caught within a refrigerator.

U.S. Pat. No. 1,937,978 to Miller discloses a latch with particular applicability for use with refrigerator doors.

U.S. Pat. No. 1,147,322 to Hampton discloses a latch for use on a coach or automobile, and wherein the pulling of a knob 10 of a plunger 9, best seen in FIG. 2, facilitates opening of the latch.

U.S. Pat. No. 3,044,287 to Pelcin discloses a door control mechanism which is adapted for use in a substantially flush-front installation, with particular emphasis on providing a latch mechanism that has no dangerously projecting handle which may cause personal injury.

U.S. Pat. No. 2,871,690 to Johnson discloses a key-operated latch mechanism which is releasable by operation of a pushbutton or rod.

U.S. Pat. No. 2,803,956 to Womer discloses a lock and latch device for use in assisting a person who may be trapped in a refrigerated enclosure, and wherein a particular structure is disclosed.

U.S. Pat. No. 3,271,982 to Welch discloses a door lock which is used in an emergency-exit environment, such as being releasable by operation of a panic-bar located on the inner side of a door carrying this mechanism.

U.S. Pat. No. 2,962,889 to McConnell discloses an emergency-exit lock for use on exit doors of public buildings, such as schools, hospitals, theatres and the like.

U.S. Pat. No. 2,945,372 discloses a door latching mechanism which is similarly particularly useful in connection with a panic lock or latch mechanism used in public or semi-public environments, such as schools or the like.

U.S. Pat. No. 2,655,395 to Groeger discloses a lock for refrigerator doors wherein, as best seen in FIG. 1, an internal mechanism is provided to enable egress from an enclosure normally locked.

U.S. Pat. No. 2,718,421 to Slopa discloses a door latch wherein another mechanical mechanism is disclosed for accomplishing results somewhat similar to those sought by the present invention in a more reliable manner.

U.S. Pat. No. 2,617,287 to Tobias discloses an escape device of a relatively primitive type wherein the handle 26 must be physically moved by means of a plunger or rod 30, a goal which is sought to be overcome by the present invention since this approach precludes the use of key-operated cylinder and padlock lock devices with a handle.

U.S. Pat. No. 2,256,447 to Burke discloses a refrigerator latch wherein a latch casing is adapted to receive the hasp of a padlock to block movement of the operating lever and thus lock the subject latch.

We wish here to further disclose two U.S. patents which have been previously assigned to the assignee of the present invention. U.S. Pat. No. 2,855,771 to Berkowitz, one of the co-inventors of the instant invention, discloses a safety lock mechanism that was developed a number of years ago and which does not afford the novel advantages and features of the present invention. U.S. Pat. No. 3,936,086, more recently issued to Berkowitz discloses an inside safety release device wherein the striker mechanism is movable and provides egress from the enclosure locked by the device.

While we do not wish to minimize the inventiveness and efforts of the inventors associated with the aforesaid prior art patents of others and while these people may be attempting to solve a problem that is similar to one of the problems solved by the present invention, it is worth mentioning a couple of representative drawbacks of these mechanisms. Firstly, if we are to provide a person locked in a coldroom with a reliable and easy means of escape through a door which is locked by a locked latch assembly, it is imperative that the structure provided for this purpose be quite highly reliable and devoid of unnecessary interactions with the locked latch assembly itself. In many of these patents the reader will see that it is necessary in one way or another to influence inner latch elements that are normally locked.

Accordingly, it is an object of the present invention to provide a safety latch mechanism that can be used with a variety of striker assemblies and which will provide a safe and rapid means of escape from an otherwise locked enclosure.

Another object of this invention is to provide a combination latch and striker assembly capable of performing the above-mentioned functions.

Another object of this invention is to provide a safety latch mechanism which provides the user with the security associated with a locked latch and striker assembly combination, but which further provides the user with the aforementioned safety features.

Still another object of this invention is to provide a novel mechanism for use with a safety latch mechanism, and which is relatively simple in design, relatively economical to produce, and highly reliable under repeated use.

According to one aspect of the present invention, the novel means and steps which are employed to overcome the disadvantages of prior art solutions associated with the problems sought to be overcome by this invention include a safety latch mechanism for use with enclosure door strikes or the like. The door latch referred to here is of the type having a movable keeper latch member adapted to releasably engage and be captively held by a stationary striker member when in a locked condition. According to this invention, a safety latch mechanism employs a movable keeper member formed with surfaces normally disposed along a patch created by door movement and capable of holding a striker member when the door latch is in a locked condition. However, safety release means which may be actuated independently of said door latch handle and which is accessible from within an enclosure locked by said door latch, may urge said keeper member out of the aforesaid latch and out of engagement with the strike thereby unlocking the door and permitting ingress to and egress from said enclosure without manipulating, moving or influencing the handle mechanism associated with the latch member.

Our invention will be more clearly understood from the following description of a specific embodiment of the invention, together with the accompanying drawings, wherein similar reference characters denote similar elements throughout the several views, and in which:

FIG. 8 is a fragmentary sectional elevational view which illustrates the interrelationships between the moving parts of the subject latch assembly, and more specifically illustrates the position of these component elements of the latch when the latch is normally opened by means of its handle;

FIG. 9 is a fragmentary sectional elevational view similar to that described for FIG. 8, but illustrating the position of the same internal elements after an initial movement of a tool or actuator from within an enclosure; and FIG. 10 is a fragmentary sectional elevational view similar to FIGS. 8 and 9, but illustrating the position of the elements of the subject latch when the tool or actuator already described for FIG. 9 has been further moved a sufficient distance to cause the keeper or tongue of the latch to become drawn out of interfering relationship with respect to the striker assembly.

Referring now in more detail to the drawings, it must be emphasized here that a number of terms and expressions used throughout this specification to designate elements and assemblies of elements of the present invention have been chosen merely as a matter of convenience for the reader. It must also be emphasized here that the latch and lock arts contain many expressions and terms which often delineate and describe the same element for a combination of elements. Therefore, I have chosen to designate by the term "latch" that portion of the over-all door-locking assembly which is normally mounted on the door and is most easily recognized in FIG. 1 by its associated upstanding handle. The cooperative jamb-mounted assembly which forms part of the present invention in terms of its cooperative use with the safety closure latch to be described in more detail, has been generally designated a "strike assembly" in order to clearly distinguish between the cooperative but structurally independent mechanisms. The possible or occasional use of the word "strike," as opposed to the word "striker," to describe the strike assembly, has been done without any intention of altering the conventional meaning of these somewhat synonymous words.

Figure 1:
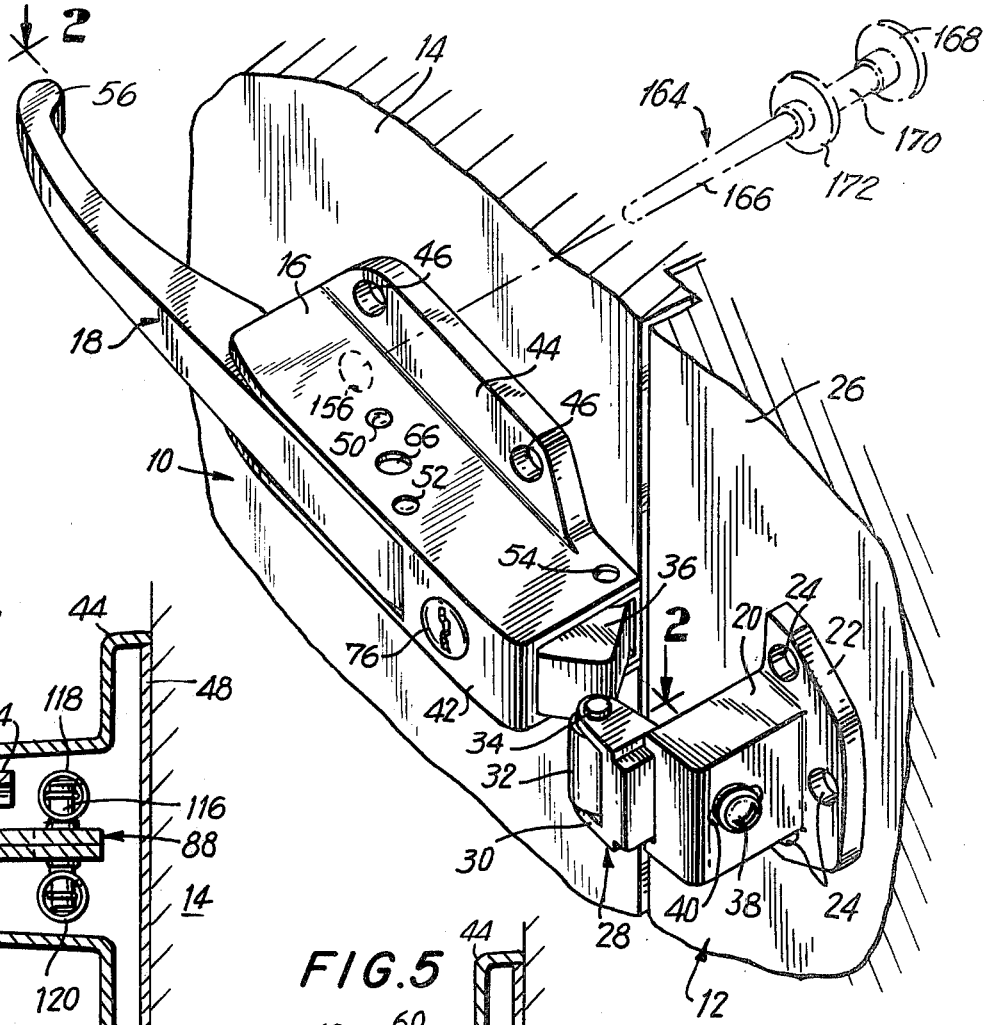
FIG. 1 is a fragmentary perspective view shown in exploded form and which illustrates the latch comprising the safety closure system according to the present invention, in its relationship with an associated striker assembly.

In FIG. 1, a latch assembly 10 and a strike assembly 12 are shown cooperatively mounted upon a door and a jamb, respectively. Latch assembly 10 may be easily mounted on the edge of a door 14 and, as shown in FIG. 1, may be mounted flush with the surface of the door to eliminate substantially all hazards of protruding hardware. The body or housing 16 of latch assembly 10 is preferably made of high-pressure zinc dye-casing, while the upstanding handle 18 thereof is preferably brass. Highly polished chromium plating is preferably used as a finish on these parts, although the present invention contemplates using materials other than zinc and brass which are comparable and/or equivalent.

Before describing latch assembly 10 in more detail, we wish here to direct ourselves to strike assembly 12, best shown in FIG. 1, wherein the strike assembly is shown to include a body portion 20 which is formed with an integral mounting flange 22 through which three mounting holes or openings 24 are formed. Of course, the exact shape of mounting flange 22 and the specific number of mounting holes is unimportant in terms of the performance of the functions of strike assembly 12. It is through mounting holes 24 that suitable and conventional fasteners normally extend in supporting and holding mounting flange 22 and, thus, strike assembly 12 to a jamb 26, or the like.

Body portion 20 of strike assembly 12 adjustably supports a strike roller assembly 28, which is movable within a predetermined range of offsets which may be a function of the thickness and types of structures to which the latch and strike assemblies 10 and 12 are to be secured and used with. Strike roller assembly 28 comprises a yoke-shaped body 30 which pivotally holds a roller member 32 by means of a pin 34. Roller member 32 is freely able to rotate about the axis of pin 34 and provides a surface against which a tongue or keeper 36 associated with latch assembly 10 comes into contact and actually "strikes." Keeper or tongue 36 will be described in terms of its relationship with other components or elements of latch assembly 10 further below within this specification.

The adjustability of the position of body 30 with respect to body portion 20 of strike assembly 12 is facilitated by an adjusting bolt 38, which is shown in FIG. 1 to extend through a slotted opening 40 formed through body portion 20 and into engagement with strike roller assembly 28. Thus, the user of the present invention is able to manipulate adjusting bolt 38 by means of a screwdriver, for example, and, by loosening adjusting bolt 38 and sliding strike roller assembly 28 to the position desired, and thereafter tightening adjusting bolt 38, a selected position of the roller member 32 with respect to the latch assembly tongue or keeper 36 is quickly and efficiently achieved.

It must be strenuously emphasized here that the specific strike assembly 12 that has just been described and is disclosed within this specification is only one of a variety of strike assemblies that may be used with the latch assembly 10 comprising the present invention. Stated differently, it is the proper scope of the appended claims that we seek to have define our invention, rather than the specific examples set forth in the specification and illustrated in the drawings in order to give the reader an appreciation of the operability and structural makeup of the present invention.

Turning now to latch assembly 10, the drawings indicate that the latch assembly includes a housing or body 42 of an attractive and utilitarian shape, which is formed with oppositely extending mounting flanges 44 formed with holes or openings 46 therethrough. While not specifically shown, holes 46 accommodate mounting fasteners or bolts which hold the entire housing 42 to the door 14. It is preferably intended that the entire latch assembly 10 be mounted on door 14 such that the roller member 32 of strike assembly 12 is in the patch of tongue or keeper 36 such that, when the door 14 is closed against jamb 26, tongue 36 will strike roller member 32 and pivot in a manner that will be described in more detail later. A bottom plate 48 which may be either pivotally attached to bottom portions of housing 42 or actually removable therefrom is shown in sectional views 4–7 as serving to enclose the internal elements of latch assembly 10 together with housing 42.

Figure 2:
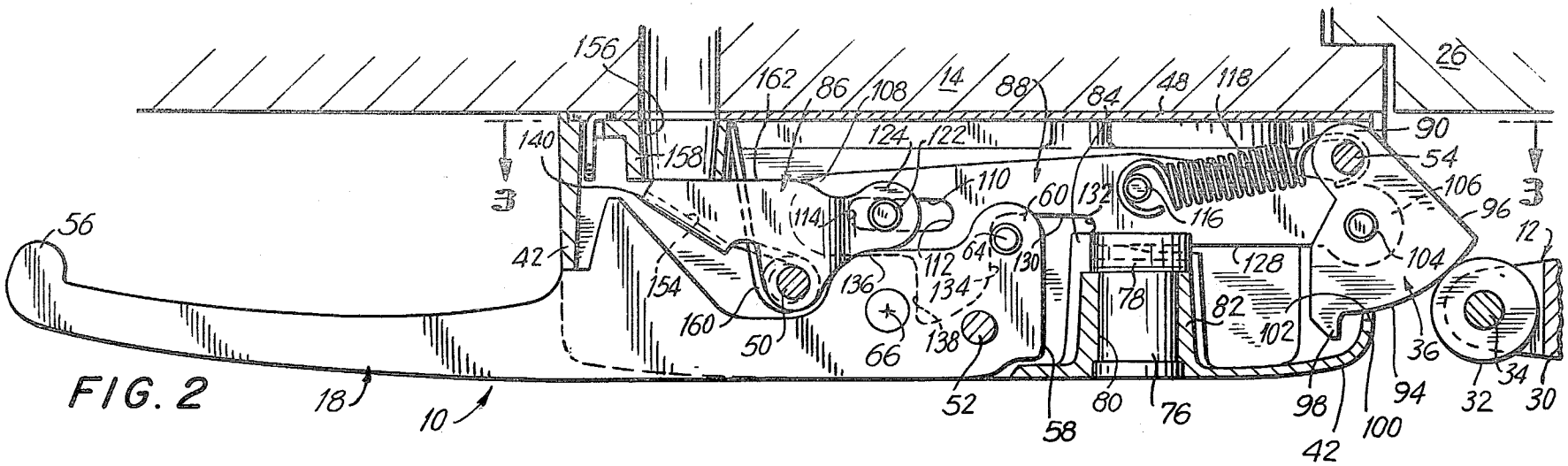
FIG. 2 is a fragmentary sectional view taken along the line 2—2 of FIG. 1.
Figure 3:
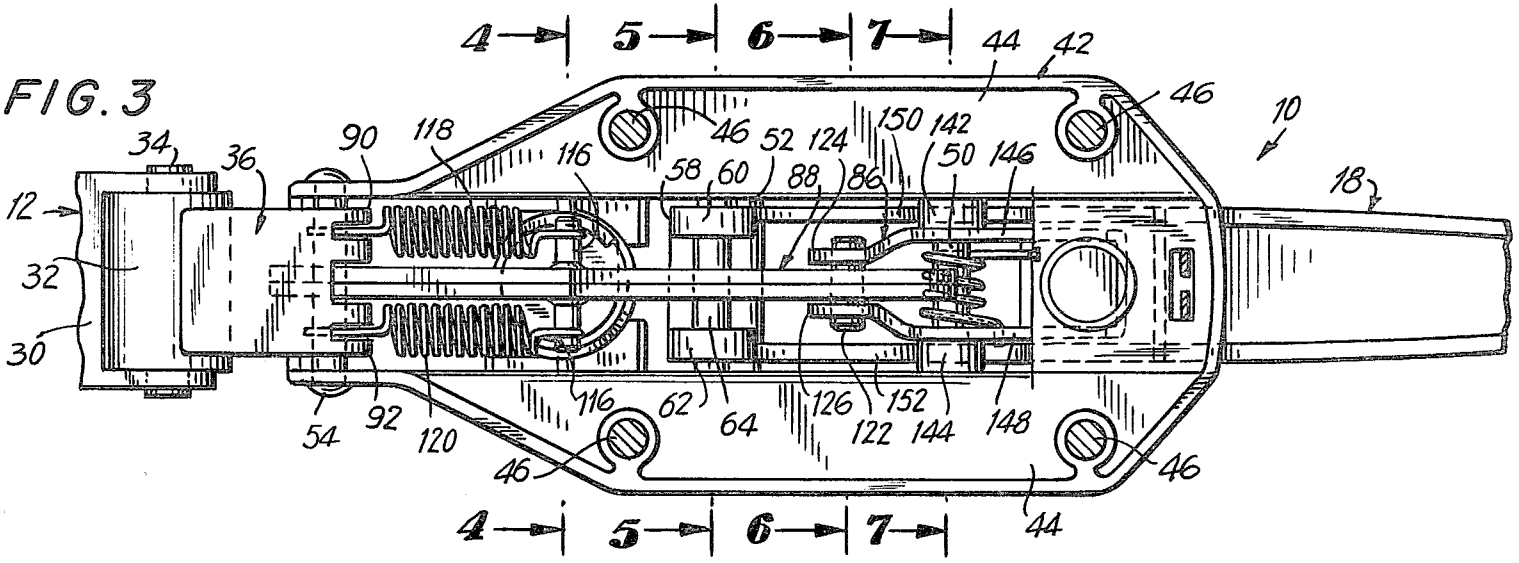
FIG. 3 is a fragmentary plan view taken along the line 3—3 of FIG. 2, and illustrating the internal arrangement of components of the subject latch assembly.

Referring now to FIGS. 2 and 3, the reader will see in sectional elevational and bottom plan views internal linkage elements of latch assembly 10. In this regard, the reader is cautioned not to consider FIGS. 2 and 3 as projections of one another but, on the contrary, it will be seen from the further description of this invention that these views are reversed with the tongue 36 shown on the right side of FIG. 2 and on the left side of FIG. 3. Similarly, while the sectional views 4–7 progress from left to right in FIG. 3, it should now be apparent that they progress from left to right in FIG. 2.

Three stationary and non-removable pins 50, 52 and 54 are shown in FIGS. 1 and 2 of the drawings to extend through housing 16 and to be held by this housing. The opposite heads of each of pins 50, 52 and 54 are preferably spun or rounded in order to prevent their removal from housing 16. The longitudinal axes of pins 50, 52 and 54 define axes of pivotal movement of elements of latch assembly 10 and about which predetermined pivotal movement facilitates the functioning of the subject invention.

Figure 5:
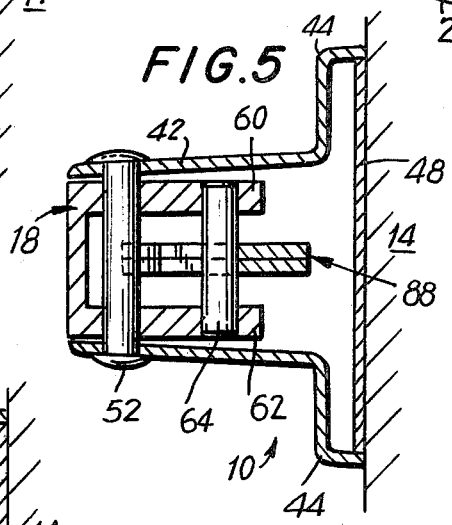
FIG. 5 is a fragmentary sectional view taken along the line 5—5 of FIG. 3.

It is pin 52 that handle 18 is supported for pivotal movement about. Handle 18 extends from a gripping extremity 56 at one end thereof to an opposite end 58 formed with somewhat rounded deepending and spaced yoke portions 60 and 62. A rollpin 64 is held by and extends between yoke portions 60 and 62 of handle 18, and, as will later be more appreciated, serves as a bearing or pushing member. FIG. 5 in a sectional elevational view will give the reader an appreciation of the relative location of these elements just described.

Figure 6:
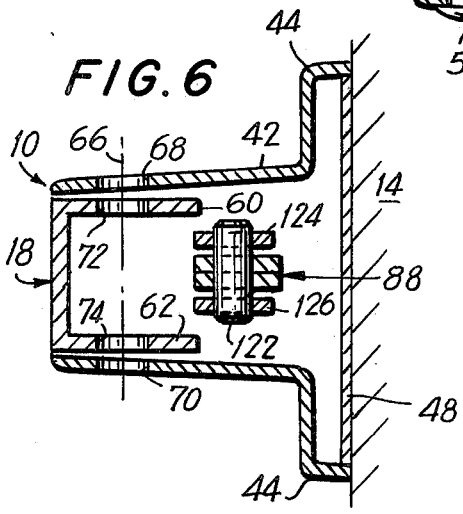
FIG. 6 is a fragmentary sectional view taken along the line 6—6 of FIG. 3.
Figure 7:
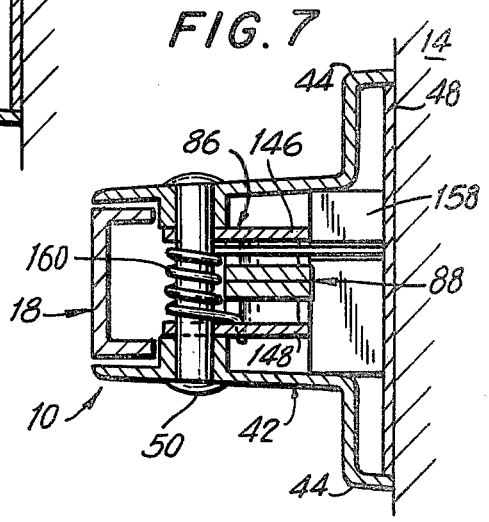
FIG. 7 is a fragmentary sectional view taken along the line 7—7 of FIG. 3.

As seen in FIGS. 1, 2, and 6, a through opening 66 which is provided to accommodate the curved portion of a padlock (not shown) extends along an axis which has been designated by reference character 66 in FIG. 6 through housing 42 and handle 18. Through opening 66 is formed by openings 68 and 70 formed through opposite sides of housing 42, as well as aligned coaxial openings 72 and 74 formed through yoke portions 60 and 62 of handle 18 (best seen in FIG. 6). FIG. 2 illustrates handle 18 in its normal closed position wherein openings 68, 70, 72 and 74 are coaxially aligned, as just described. It is in this position that either a padlock as a first locking means may be introduced through opening 66 in order to prevent unlocking movement of handle 18, and a key-operated cylinder lock 76 comprising a second locking means may be manipulated by a key to likewise prevent unlocking movement of handle 18.

Figure 4:
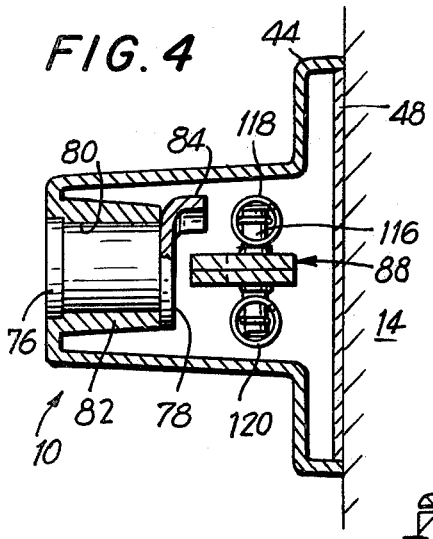
FIG. 4 is a fragmentary sectional view taken along the line 4—4 of FIG. 3.

Key-operated cylinder lock 76 is illustrated in FIGS. 1 and 4 and comprises an associated pivotally movable locking member 78 which is normally movable by use of a key which is compatible with the lock 76. Key-operated cylinder lock 76 is positioned within the face of housing 42 that is most easily accessible to the user of latch assembly 10 and is nested within a substantially cylindrical opening 80 defined by an anular boss 82 which, itself, is integrally formed with and comprises part of housing 42.

Locking member 78 associated with key-operated cylinder lock 76 is formed with an outwardly projecting and arcuately extending interference portion 84, which extends substantially perpendicularly with respect to the remaining part of locking member 78. When the user of key-operated cylinder lock 76 inserts a key (not shown) into this lock and turns the key from an unlocked position to a locked position, interference portion 84 is caused to rotate from a non-interference position to an interference position illustrated in FIGS. 2 and 4 of the drawings.

A linkage extends between pins 50 and 54, consisting of elements that are designated for purposes of this specification—a lever 86, a link member 88, and the aforementioned tongue or keeper 36.

Keeper 36 includes and is formed with yoke portions 90 and 92 through which pin 54 extends. It is pin 54 which is supported by housing 42 that, in turn, supports keeper 36 for pivotal movement thereabout. Keeper 36 is further formed with a curved bearing surface 94 against which roller member 32 of strike assembly 12 normally bears. Surface 94 extends between a substantially straight surface 96 and a protrusion 98 which extends substantially perpendicularly with respect to surface 94. As best seen in FIG. 2, protrusion 98 serves to limit the counterclockwise rotational movement of keeper 36 about the axis of pin 54 as a result of interference with portion 100 of housing 42 which helps define the opening 102 in the housing 42 through which keeper 36 extends into contact with strike assembly 12.

Keeper 36 is linked or pivotally connected to link member 88 by means of a roll pin 104 which extends through each of these members. Roll pin 104 interconnects keeper 36 with a forward end 106 of link member 88. Link member 88 extends between the just mentioned forward end 106 and a rearward end 108 which, near its extremity, is formed with an elongated slot 110 therethrough. Slot 110 extends substantially longitudinally with respect to the substantially longitudinal axis of link member 88, and is at least partially defined by forward and rearward surfaces 112 and 114, respectively. A pin 116 is substantially integrally connected and extends transversely through link member 88. It is pin 116 that serves to further interconnect link member 88 with keeper 36 by means of helical tension springs 118 and 120 which, in turn, interconnect pin 116 with pin 54 on either side of link member 88, as best illustrated in FIGS. 2 and 3 of the drawings. Since helical springs 118 and 120 are tension springs, and since pin 54 is held by housing 42, link member 88 is normally spring-biased toward the forward end of latch assembly 10 where strike assembly 12 is situated such that, by means of roll pin 104, keeper 36 is biased by means of helical springs 118 and 120 in a counterclockwise direction about the axis of pin 54. This, of course, causes bearing surface 94 of keeper 36 to assume the position shown in FIG. 2, thereby "keeping" the entire latch assembly 10 in the position illustrated in FIG. 2 behind and in engagement with strike assembly 12. This, in turn, keeps door 14 closed against jamb 26. In order to open door 14, thereby opening the enclosure normally closed by door 14, it is necessary to rotate keeper 36 in a clockwise direction about the axis of pin 54 such that the keeper assumes a non-interfering relationship with respect to strike assembly 12, and more particularly, roller member 32 of this strike assembly. This non-interfering relationship of keeper 36 with respect to roller member 32 is seen in FIGS. 8 and 10 and will be described in more detail below within this specification.

Lever 86 and link member 88 are interconnected by means of yet another roll pin 122 which, in turn, extends between yoke portions 124 and 126 of lever 86 and through slot 110 therebetween. In a preferred embodiment of this invention, link member 88 comprises a pair of integral metal straps of a configuration that will now be described in a bit more detail.

Intermediate forward and rearward ends 106 and 108 of link member 88, a predetermined structural configuration of the link member enables a novel and interesting cooperative interrelationship between the parts and components of latch assembly 10. More specifically, moving rearwardly from forward end 106, a substantially straight link surface 128 joins a substantially recessed surface 130 by means of a shoulder therebetween designated reference character 132. Recessed surface 130 interconnects shoulder 132 with an arcuately extending bearing surface 134 which, in turn, is interconnected with another recessed surface 136 by means of a second shoulder 138.

The disposition of these shoulders and surfaces is both predetermined and important as will now become apparent. Firstly, shoulder 132 is normally in an interfering relationship with respect to interference portion 84 of key-operated cylinder lock 76 if we attempt to move link member 88 to the left as shown in FIG. 2. This, of course, assumes the presence of interference portion 84 in this position only when the key-operated cylinder lock 76 has been placed in a locked mode, as shown in FIG. 2. This interference between shoulder 132 and interference portion 84 would not exist if the user of latch assembly 10 manipulated by means of a key the cylinder lock 76 from the locked mode to an unlocked mode.

Secondly, it can be seen in FIG. 2 that if we assume the presence of a padlock (not shown) extending through opening 66 provided for that purpose, there is a similar interference between shoulder 138 and the padlock if one attempts to move link member 88 to the left as shown in FIG. 2. Thus, whether by means of key-operated cylinder lock 76 and/or the use of a padlock through opening 66, movement of link member 88 from its position shown in FIG. 2 (which is a locked or closed position) rearwardly toward an unlocked or opened position best seen in FIGS. 8 and 10, can be accomplished by the user in order to prevent entry to the enclosure normally closed by door 14.

When neither the cylinder lock 76 nor the padlock which may extend through opening 66 is utilized, the user of latch assembly 10 may open the door 14 by pulling upon handle 18. This causes roll pin 64 to bear against bearing surface 134 (see FIG. 8) which, in turn, pulls link member 88 to the left against the force of helical springs 118 and 120, thereby by means of roll pin 104 causing keeper 36 to rotate clockwise about the axis of pin 54 out of interfering relationship with respect to roller member 32. This rearward movement of link member 88 is limited by means of interference between roll pin 122 and the forward surfaces 112 of slot 110. Upon release of handle 18, link member 88 will return to the right under the force of springs 118 and 120 such that, again by means of roll pin 104, keeper 36 will return to the position shown in FIG. 2 by counterclockwise movement about the axis of pin 54. This action just described utilizing handle 18 in the absence of the presence of a padlock through opening 66 and in the absence of the cylinder lock 76 being locked illustrates the normal unlocked use of latch assembly 10. Of course, as can now be surmised, the unlocking movement of handle 10 can be prevented by either the locking of cylinder lock 76, or the insertion of a padlock through opening 66, or for that matter, both.

We turn now to lever 86 which extends between its yoke portions 124 and 126 on the rightmost side thereof as seen in FIG. 2, to its leftmost end 140. Lever 86 is supported for pivotal movement by and about pin 50. Pin 50 is held within and between inwardly directed bosses 142 and 144 of housing 42. More specifically, pin 50 extends from boss 142 through side 146 of lever 86 and thereafter through side 148 of lever 86 into engagement with boss 144. This can best be seen in FIG. 3 of the drawings.

Sides 146 and 148 of lever 86 are disposed within and between sidewalls 150 and 152 of handle 18. In this way there is no interference as a result of any rotation of lever 86 in a counterclockwise direction about the axis of pin 50, as shown in FIG. 2. Lever 86 is further formed with a substantially flat bearing wall 154 which extends between sides 146 and 148 and integral therewith at a location overlying the axis of an actuator opening 156 defined by an annular wall 158 integral with housing 42.

Lever 86 normally assumes the position shown in FIG. 2 as the result of the presence of a tortional spring 160 which encircles pin 50 and is anchored against wall 158 at one end, with its extreme end engaging side 148 of lever 86. In this way, lever 86 is biased in a clockwise direction about the axis of pin 50 such that its substantially straight surfaces 162 are biased into engagement with wall portions 158 defining actuator opening 156.

In FIG. 1, a release actuator 164 is shown in an exploded representation with respect to actuator opening 156 just described. It is contemplated that the present invention be utilized with a known or conventional release actuator of the type previously marketed and known to the art, or any other suitable tool or actuator, without limiting the scope of this invention. For the sake of clarity, actuator 164 will be described as comprising an elongated shaft or rod 166 which extends from handle 168, through an insulated tube 170, and thereafter through a mounting flange 172. While shaft or rod 166 is preferably metallic, the remaining parts of actuator 164 may be plastic or other suitable frost-free material.

We have previously in this specification described the normal operation of latch assembly 10 in terms of the use of handle 18 giving the user access to the enclosure normally closed by door 14 in the absence of either a padlock through opening 66 or a locked key-operated cylinder lock 76. This, however, does not help a locked-in party who has been entrapped within the coldroom sealed by door 14. It should be emphasized here that the danger of entrapment of individuals or personnel within a cold room or a walk-in cooler has always been a concern of the industry. Such entrapments may occur accidentally, or may actually result from the malicious conduct of another party. Evidence of governmental concern about this issue can be found in the enactment of safety laws which require safety latches for walk-in boxes. The State of California, for example, has enacted such laws. Other governmental agencies, such as the U.S. Army Quartermaster Division and the Veterans Administration expressly specify safety-type latches for their equipment.

According to the present invention, if we look now at FIGS. 9 and 10 in conjunction with the previous figures of the drawings, it can be seen that an entrapped or locked-in party who is unable to receive help from outside the coldroom locked by locked latch assembly 10 is able to push knob or handle 168 such that rod or shaft 166 is moved against the compressive biasing return forces of a helical spring (not shown) located within tube 170, such that rod or shaft 166 enters actuator opening 156—best seen in FIGS. 9 and 10. For purposes of this illustration, we will assume that a padlock is in place within opening 66, and that, in addition, the key-operated cylinder lock 76 has been placed in a locked mode either unintentionally or intentionally. We will further assume that there is no assistance or help available to the entrapped party such that throughout this description of the operation of this invention, both the padlock and the cylinder lock will remain in their locked positions and mode.

Upon initial entry of rod or shaft 166 associated with actuator 164 through actuator opening 156, the actuator rod 166 first engages bearing wall 154 of lever 86 and, upon further inward movement, causes lever 86 to rotate in a counterclockwise direction about the axis of pin 50 and against the normally counterclockwise biasing forces of tortional spring 160. This, in turn, causes roll pin 122 to both move link member 88 upwardly as shown in FIG. 9 to a position whereby shoulder 132 no longer is in interfering relationship with respect to interference portion 84 of cylinder lock 76, and, roll pin 122 further moves within slot 110 into contact with rearward surfaces 114 defining slot 110. This last-described movement and positioning is best illustrated in FIG. 9. It can also be seen in FIG. 9 that the upward movement of link member 88 that enabled shoulder 132 to clear interference portion 84 likewise has caused shoulder 138 to move into a non-interference position with respect to the padlock extending through opening 66. Thus, link member 88 and its portions have been moved into a position whereby the padlock and the cylinder lock no longer present any interference therewith.

FIG. 10 illustrates that yet further movement or entry of actuator rod 166 into and through actuator opening 156 results in yet further counterclockwise movement of lever 86 about the axis of pin 50 with the result that roll pin 122 forces rearward surfaces 114 to the left as shown in FIG. 10 such that the entire link member 88 is moved to the left against the normal tensile biasing forces of springs 118 and 120. This movement of link member 88 to the left, as a result of the interconnection of link member 88 and keeper 36 by means of roll pin 104, causes keeper 36 to move in a clockwise direction about the axis of pin 54 until the straight surfaces 96 thereof are either actually able to enter opening 102 or at least clear the interfering relationship with roller member 32 of strike assembly 12.

As seen in FIG. 10, there is no impediment to the opening of door 14 and further movement or continued movement of actuator rod 166 in the same direction will actually provide forces against the door which are in the opening direction, thereby enabling a transmission of force in the opening direction between actuator rod 166 and the housing 42 of latch assembly 10. The entrapped person by further pushing, therefore, will cause the door 14 to open and egress has now been enabled, nowithstanding the presence of a padlock through opening 66, or a locked cylinder lock 76, or for that matter, both.

Interestingly, once the entrapped person has left the enclosure within which he or she was entrapped, the door may be either closed to a point where significant heat will not enter the enclosure, or, for that matter, the formerly entrapped party may obtain the keys to either or both of the padlock and/or the cylinder lock to completely close the latch assembly 10 and door 14 and return the enclosure to a secure condition.

Significant advantages of the present invention reside in the subject mechanism having a relatively soft closing action, while in addition providing a pilfer proof latch assembly in which the keeper cannot be depressed when the latch is locked—while at the same time providing an absolutely safe latch assembly that will open from the inside with either a standard inside release handle or another tool, whether the latch assembly is padlocked, cylinder locked, or both. The safety latching action works completely independently of the handle 18. In addition, the radial tongue structure permits smooth, relatively easy closure minimizing the undesirable noise created by conventional bolt-action latches upon hitting the strike.

The embodiment of the present invention particularly disclosed and described hereinabove is presented merely as an example of the invention. Other embodiments, forms and modifications of the invention coming within the proper scope and spirit of the appended claims will, of course, readily suggest themselves to those skilled in the art.

What is claimed is:

1. A safety method of unlocking a door to an enclosure from within the enclosure, said door carrying a latch assembly having a movable keeper latch member normally influenced by unlocking movement of a latch handle and adapted to releasably engage and be captively held by a substantially stationary striker member when in a locked condition, the method comprising the steps of: urging a safety actuating member from a locked position to an unlocking position, translating said movement of said actuating member into arcuate movement of a lever member which is normally biased in a locking direction opposite with respect to that of said arcuate movement, said biasing normally inhibiting said lever member arcuate movement during times when said actuating member is not in said unlocking position, said step of translating further causing movement of a link member interconnecting said lever and said movable keeper latch member from a locking position to an unlocking position; said step of translating yet further causing arcuate movement of said keeper latch member from substantially interfering locking relationship with respect to said striker member and permitting ingress to and egress from an enclosure normally closed by a door carrying said keeper latch member without requiring unlocking movement of said latch handle, said step of translating still further being capable of causing movement of internal interfering surfaces of said link member from an interfering locking position with respect to a locking cam member influenced by a locking cylinder to non-interfering positions.

2. The method of claim 1, further including the step of removing said safety actuating member from said unlocking position, thereby enabling spring biased return of said lever, link and latch members to their respective initial locking positions.

* * * * *